United States Patent [19]

Honjo

[11] 4,163,359

[45] Aug. 7, 1979

[54] METHOD AND APPARATUS FOR DRIVING AND PIECING-UP OPEN-END SPINNING UNITS

[75] Inventor: Takeshige Honjo, Suita, Japan

[73] Assignee: Murata Kikai Kabushiki Kaisha, Japan

[21] Appl. No.: 538,589

[22] Filed: Jan. 6, 1975

[30] Foreign Application Priority Data

Jan. 14, 1974 [JP] Japan ..... 49-7217

[51] Int. Cl.[2] ..... D01H 1/30; D01H 15/00

[52] U.S. Cl. ..... 57/93; 57/263; 57/58.89; 57/100; 57/105

[58] Field of Search ..... 57/34 R, 58.89–58.95, 57/92, 93, 100, 102, 104, 105

[56] References Cited

U.S. PATENT DOCUMENTS 3,704,579 12/1972 Tooka et al. ..... 57/93 X 3,780,513 12/1973 Wanatabe et al. ..... 57/93

3,810,352 5/1974 Miyazaki et al. ..... 57/58.95 X

*Primary Examiner*—Charles Gorenstein

*Attorney, Agent, or Firm*—Whittemore, Hulbert & Belknap

[57] ABSTRACT

The present invention relates to a method and an apparatus for changing the ratio of the yarn taking-up speed to the number of revolutions of the rotor at the time of yarn piecing and normal spinning. According to the present invention, the ratio of the yarn taking-out speed to the number of revolutions of the rotor at the time of yarn piecing has a different value from that employed at the normal spinning, while the ratio of the yarn taking-out speed to the sliver supply speed is made constant at the time of yarn piecing as at the normal spinning, in a manner such that the spun yarn has fewer number of twists at the normal spinning than that at the time of yarn piecing. The rotor speed may also be simultaneously reduced as the speeds of the take-out and sliver supply are reduced.

5 Claims, 9 Drawing Figures

METHOD AND APPARATUS FOR DRIVING AND PIECING-UP OPEN-END SPINNING UNITS

BACKGROUND OF THE INVENTION

It is known experimentally that when piecing a cotton yarn, $10^s$, in an open-end spinning machine at the rotor speed of 30,000 r.p.m., the yarn breakage would occur with the yarn taking-out speed (YS) higher than 48.2 m/min., resulting in failure in yarn piecing. This means that the broken yarn can not be pieced up continuously with the spun yarn during spinning unless the continuous spinning operation is carried out at the yarn taking-out speed of 48.2 m/min. Since the latter can be elevated during continuous spinning to a higher value, say 68.8 m/min., the continuous spinning at the yarn taking-out speed of 48.2 m/min. represents a decrease of about 30 percent in the output of spun yarn. On the other hand, it is well-known that the spinning conditions of the open-end spinning unit, viz. the physical properties and the structure of the spun yarn, are determined by the following equations:

$$\text{Draft ratio} = \frac{\text{yarn taking-out speed (m/min)}}{\text{sliver supply rate (m/min)}} \quad (1)$$

$$\text{Number of twist (G/M)} = \frac{\text{rotational frequency of rotor (r.p.m.)}}{\text{yarn taking-out speed (m/min)}} \quad (2)$$

The draft ratio in the above equation (1) may be considered the ratio of the count of yarn of the spun yarn to that of the sliver supplied into the rotor. This means that the count of yarn of the spun yarn is determined for a given count of yarn of the sliver and a given draft ratio. The number of twists in the equation (2) represents the number of twists per unit length of the spun yarn. Unless the draft ratio in the equation (1) is fixed for both yarn piecing and spinning operations, the yarn being spun at the normal spinning will have a different size of fiber from that of the pieced up yarn. Thus the equation (1) must be satisfied during normal spinning and yarn piecing.

Thus, provided that the ratio of the sliver supply speed to the yarn taking-out speed is always constant, the ratio of yarn taking-out speed to the rotational frequency of the rotor for the yarn piecing may be different from that used for normal or continuous spinning, in a manner such that a fewer number of twists may be inserted during the yarn piecing. In this case, the yarn end and the fiber interlock with each other satisfactorily with an elevated rate of successful yarn piecing operation and a normal size of yarn in the pieced up portion of the spun yarn is obtained.

BRIEF SUMMARY OF THE INVENTION

An object of the present invention is to provide a method and an apparatus for driving a spinning system, according to which the yarn piecing operation is carried out under an optimum spinning condition proper to the yarn piecing and, upon completion of the yarn piecing, the spinning condition is shifted smoothly to an optimum spinning condition proper to the normal spinning and naturally different from that proper to the yarn piecing.

Another object of the present invention is to provide a method and apparatus for driving a spinning system, according to which the spinning conditions different from the continuous normal spinning are adopted for yarn piecing in such a manner as to increase the number of twists during the yarn piecing and to enable high-speed spinning of finer yarn with fewer count of yarn with resulting increase in the output of spun yarn.

These and other objects of the invention will become more apparent from the following detailed description of the invention especially when read in conjunction with the accompanying drawings.

DETAILED DESCRIPTION OF THE INVENTION

Figure 1:
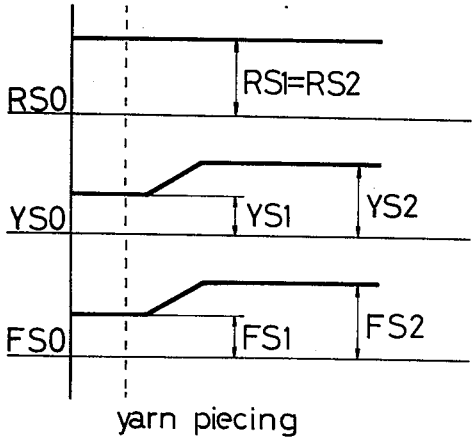
FIG. 1 is a graphic chart showing a driving method of the invention according to which the number of twists inserted into the yarn is changed by simultaneously changing the yarn taking-out speed (YS) and the sliver supply speed (FS) with the rotational speed of the rotor (RS) being unchanged.
Figure 2:
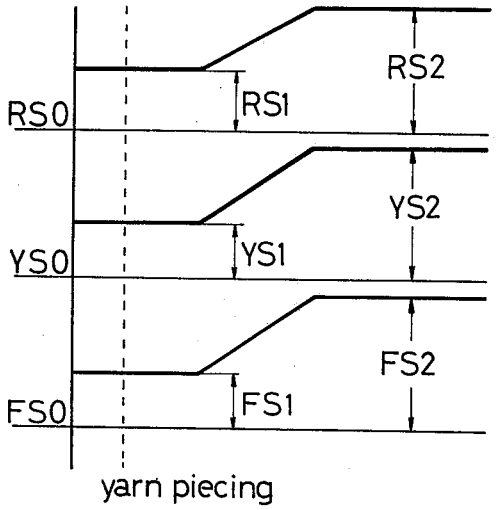
FIG. 2 is a graphic chart showing an alternative method of the invention according to which the number of twists is changed by simultaneously changing the rotational speed of the rotor (RS), the yarn taking-out speed (YS) and the sliver supply speed (FS)

FIG. 1 shows, as an operating principle of the present invention, a driving system wherein the number of twists is changed by changing the sliver supply speed (FS) and the yarn taking-out speed (YS) simultaneously, without changing the rotor speed (RS). FIG. 2 shows, as an alternative operating principle of the present invention, a driving system wherein the number of twists is changed by changing the rotor speed (RS), the sliver supply speed (FS) and the yarn taking-out speed (YS) simultaneously. In any way, the speed-changing ratio of each driving electric motor should be designed, by using a proper program with the means of timers, so as to satisfy both the following equations:

$$\text{Draft ratio} = \frac{YS1}{FS1} = \frac{YS2}{FS2} \quad (3)$$

and $$\text{Number of twists} = \frac{RS1}{YS1} > \frac{RS2}{YS2} \quad (4)$$

wherein YS1, FS1 and RS1 are the operating speeds of the respective elements for yarn piecing, and YS2, FS2 and RS2 are those for normal spinning.

The above equations (3) and (4) can be satisfied practically and conveniently by such an arrangement wherein the wind-up drum for taking out the yarn and the feed roller for supplying the sliver into the rotor are connected to a first motor and the rotor is connected to a separate motor which has a different speed-reducing mode or ratio from that of the first motor. It is to be noted that the diagram of FIG. 1 or 2 may also represent a curve instead of a straight line shown therein on account of the motor characteristics.

Figure 3:
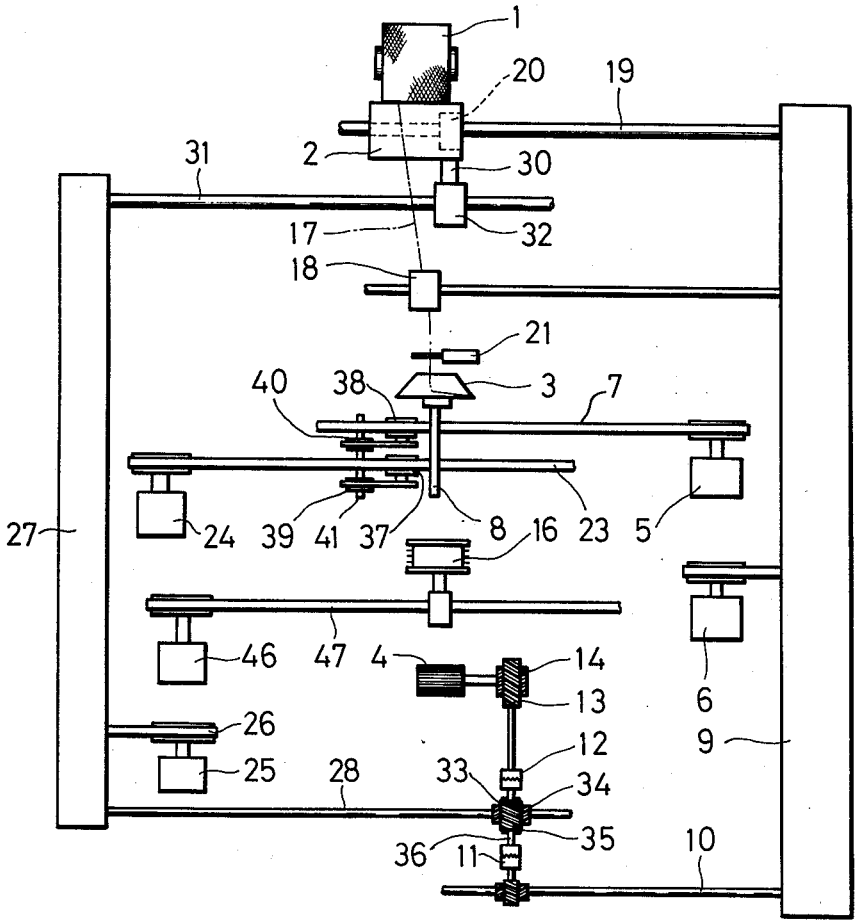
FIG. 3 is a diagrammatic view showing an example of the motion-transmitting mechanism used in the first embodiment of the invention.
Figure 4:
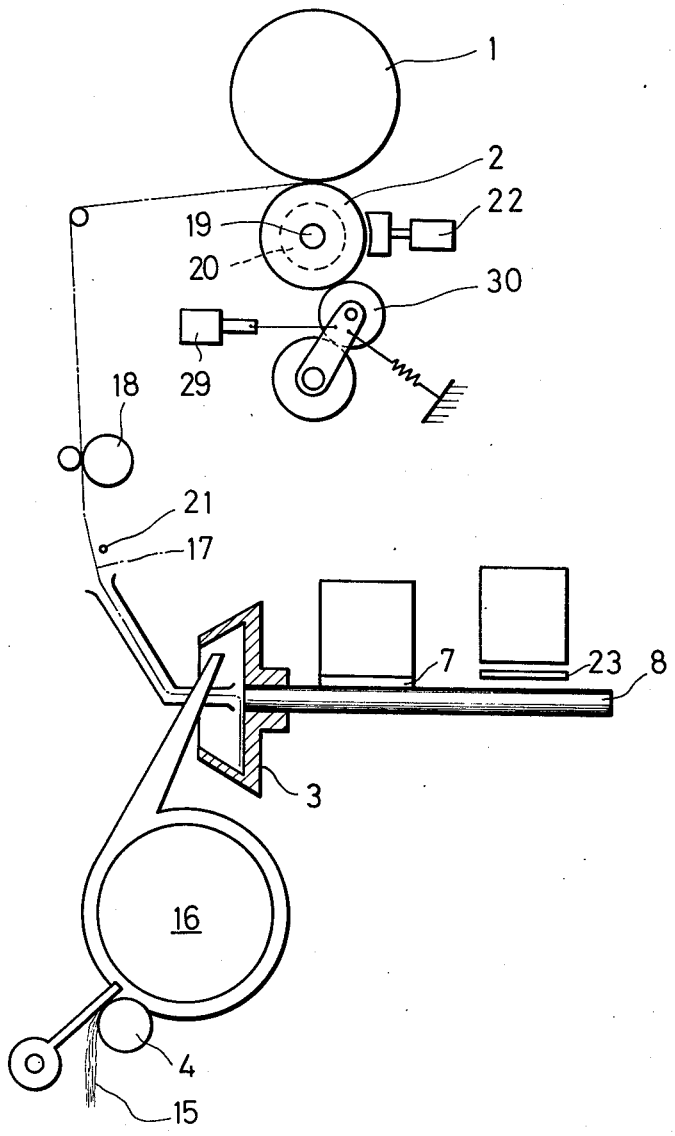
FIG. 4 is a diagrammatic side elevation of FIG. 3.
Figure 5:
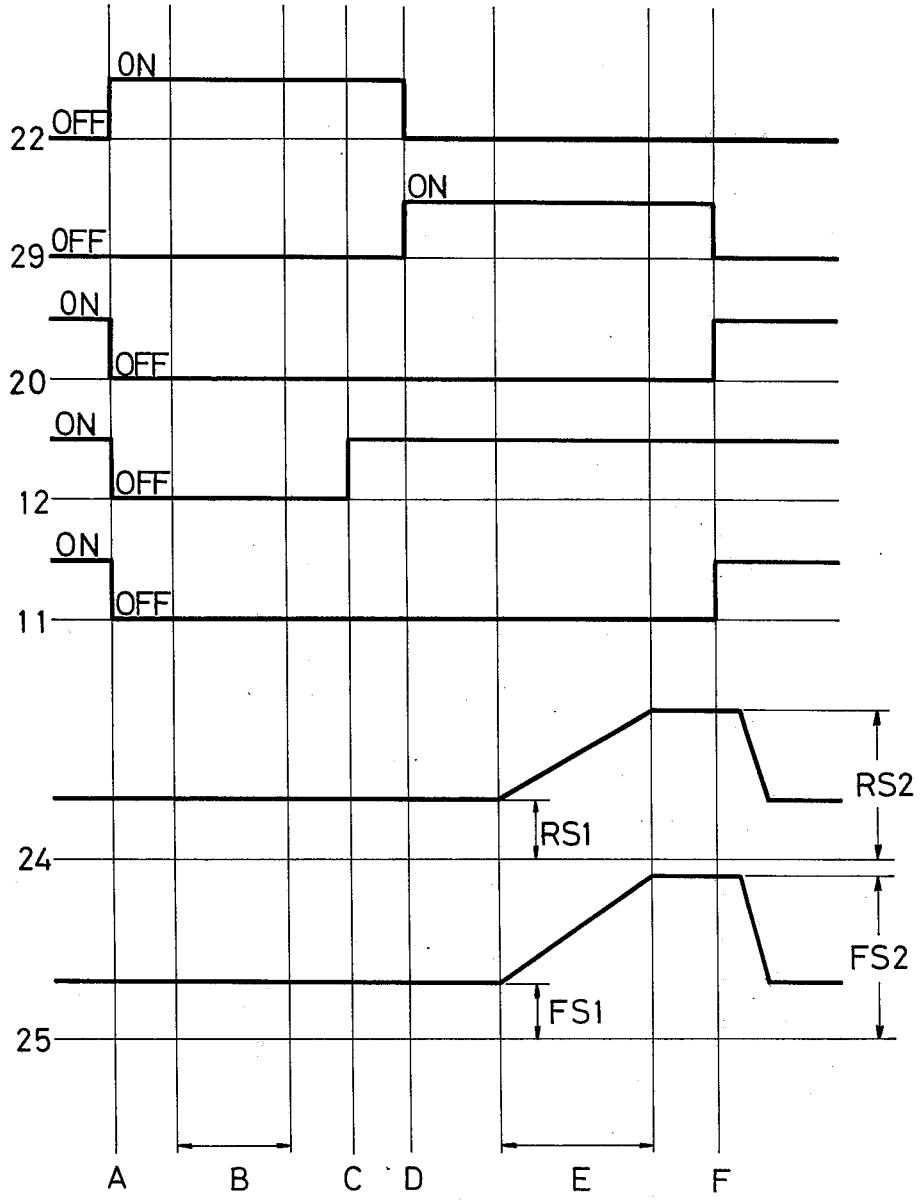
FIG. 5 is a diagram for showing the operational sequence of the first embodiment of the invention.

In the first embodiment shown in FIGS. 3 to 5, each spinning unit is formed by a wind-up drum 2 for package 1, a spinning rotor 3 and a sliver feed roller 4, as spinning element. A main high drive transmission mechanism for normal spinning and an auxiliary drive transmission means for yarn piecing are provided in common to a number of such juxtaposed spinning units which can be switched separately between said main and auxiliary drive systems. The auxiliary drive means is provided with two drive sources one of which is connected directly to a drive transmission means of the spinning rotor, the other drive source being connected directly to a drive transmission means of the wind-up drum 2 and the feed roller 4. These driving sources represent mutually different speed-changing modes. In FIG. 3, the motor 5 connected to the rotor 3 through the high-speed transmission mechanism may be omitted and the rotor may be connected to a single motor 6 which is connected to the drum 2 and the feed roller 4 through the high-speed transmission mechanism.

During normal spinning, belt 7 is driven by an electric motor 5 designed for normal spinning operation. Belt 7 is kept in contact with a rotor shaft 8 which is thereby rotated for rotating the spinning rotor at a high speed of 60,000 r.p.m. A further electric motor 6 designed equally for normal spinning operation is connected to a gearing 9 which is thus driven with the rotation of the motor 6. A feed shaft 10 is connected directly with the gearing 9 and with a worm 13 through a first or high-speed feed clutch 11 and a second or speed-change feed clutch 12 so that the rotation of the feed shaft 10 is transmitted to the worm 13 and thence to a pinion 14 fitted securely to the worm 13. Said pinion 14 is formed as one with a feed roller 4 which is thus rotated with the pinion 14 so as to feed the sliver 15 towards the rotor 3. The sliver 15 is opened by an opening roller 16 and the thus opened sliver is supplied into the spinning rotor 3. The opened sliver is entangled with the end of the yarn 17 which performs a gyratory movement in contact with the inner surface of the revolving rotor 3. Thus, the sliver is formed again into the form of a yarn and taken out by a delivery roller 18 to be wound up on a rotating package 1. The rotation of the package 1 is caused by that of a shaft 19 which is connected directly with the gearing 9 and which is also connected to said drum 2 by way of a clutch designed for high-speed winding 20.

In case of a yarn breakage, an electrical signal is produced by a sensor 21 which senses such yarn breakage and the clutch 20 is disconnected by said signal. At the same time, a solenoid 22 is energized to brake the wind-up drum 2 and the package 1. The speed-change feed clutch 12 is also disconnected by said electrical signal from the sensor 21 so that the rotation of the feed roller 4 and hence the supply of the sliver are interrupted. Simultaneously, the high-speed feed clutch 11 is also disconnected to make ready for the subsequent operation. Thus the package 1 is brought to a stop upon the occurrence of yarn breakage so that the operator can easily detect the spinning unit where the yarn is broken. The operator then applies a brake to the rotor 3 in order to remove the dust and dirt which has accumulated in the rotor. Next, the operator sets the belt 7 aside from the rotor shaft 8 and places a belt 23 in contact with the rotor shaft 8. Said belt 23 is driven by a speed-change electric motor 24 at a slow speed so that the rotor 3 starts to rotate at an equally slow speed. Another speed-change electric motor 25 is rotated at this time at a slow speed. The rotation of this motor 25 is transmitted via a belt 26 to a speed-change gearing 27 so as to rotate a speed-change winding shaft 28 connected directly to the gearing 27. A speed-change feed shaft 28 also connected directly to the gearing 27 is rotated under no load at a slow speed, as the speed-change feed clutch 12 and the high-speed feed clutch 11 are disengaged. The operator then unreels a certain length of the yarn 19 from the package and throws the yarn length as an end yarn into the rotor 3. The yarn length thus thrown into the rotor 3 is rotated therewith and placed under a tension due to the centrifugal force produced in the rotor 3. The sensor 21 senses the yarn tension and issues an electrical signal so as to connect the speed-change feed clutch 12. The rotation of the speed-change feed shaft 28 is now transmitted to the feed roller 4 via worm 13 and pinion 14 so that the sliver starts to be supplied into the rotor 3. Then, after a time interval T1 as from the time of issuance of the electrical signal by the sensor 21, the solenoid 22 is deenergized to release the braking pressure which has so far been applied to the drum 2. Another solenoid 29 is energized simultaneously with deenergization of the solenoid 22 and a friction roller 30 is thereby forced as a wedge into an interval between the wind-up drum 2 and a pulley 32 secured to the speed-change winding shaft 31. Thus the rotation of the shaft is transmitted to the drum 2 by way of the pulley 32 and the friction roller 30 so that the package 1 starts again to rotate and the taking-out operation of the yarn or the winding operation is started again. Thereafter, the speed-change motors 24, 25 start to be accelerated simultaneously until the maximum speeds are reached simultaneously. The rotational speeds of the winding drum 2, feed roller 4 and the rotor 3, i.e., the spinning speed, corresponding with said maximum speeds of the motors 24, 25 are so designed as to be equal to or slightly smaller than those corresponding with the normal spinning. The speed change mode of the motor 24 and that of the motor 25 are so selected that the equation (4)

$$RS1/YS1 \geqq RS2/YS2$$

may be met between the rotor speed and the sliver supply rate corresponding with yarn piecing and normal spinning. The equation (3)

$$YS1/FS1 = YS2/FS2$$

may naturally be met since the feed roller 4 and the winding drum 2 are driven by the same motor 6 (normal spinning) or 25 (yarn piecing-up operation).

Figure 8:
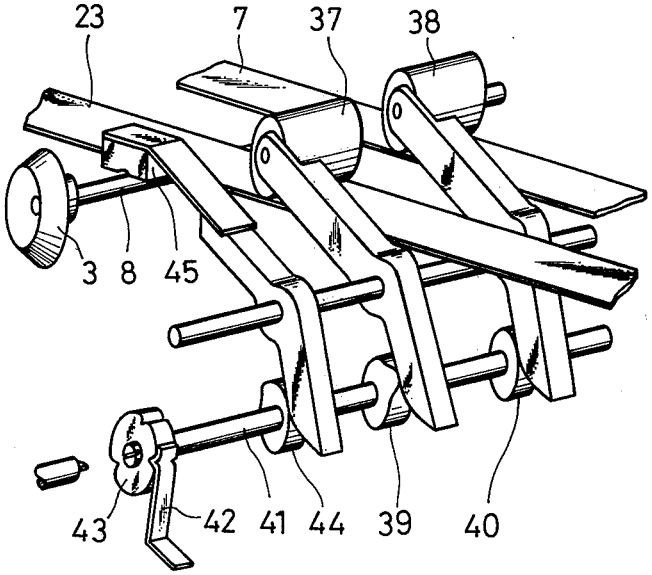
FIG. 8 is a detailed perspective view showing a cam device used in the first embodiment of the invention.

As the speed-change motors 25, 24 have attained their maximum speeds, the high-speed wind-up clutch 20 is connected. Simultaneously, the solenoid 29 is de-energized to release the pressure applied by the friction roller 30 on the wind-up drum 2, thus the normal winding operation being started. Simultaneously therewith, the high-speed feed clutch 11 is engaged and thus the rotation of the high-speed feed shaft 10 is transmitted to the feed roller 4 through high-speed feed clutch 11, worm 13 and speed-change feed clutch 12. The worm 34 mounted to the speed-change feed shaft 28 meshes with a helical gear 33 which engages with shaft 36 by the intermediary of a one-way clutch 35 provided in the inside of a helical gear 33. The arrangement is such that when the rotational speed of the shaft 36 is larger than that of the helical gear 33, the one-way clutch 35 will be disengaged to permit said shaft 36 to rotate freely in one direction, the gear 33 then being rotated under no load for realizing the normal supply speed of the sliver 15. The rotor 3 can be switched between the two transmission systems by bringing the belt 7 into contact with the rotor shaft 8, with the belt 23 being kept in contact with the rotor shaft 8, and immediately separating the belt 23 away from the rotor shaft 8. The belts 23, 7 can be engaged with or separated from the rotor shaft 8 by separately pressing two tension pulleys 37, 38 on to the belts 23, 7, respectively. These tension pulleys 37, 38 are connected with cams 39, 40 mounted on a common shaft 41. These cams are dephased relatively to each other so that one of said tension pulleys 37, 38 may be pressed to the belt for engaging the latter with the rotor shaft upon rotation of the shaft 41 as far as a predetermined angular position. As shown in FIG. 8, a leaf spring 42 is mounted for engaging with a cam 43 provided to the shaft 41 to prevent occasional displacement of the cams 39, 40 due to minute mechanical oscillations. The rotor shaft 8 can be braked as occasion may require by a brake shoe 45 associated with a cam 44. The rotor, winding shaft and the feed roller are now returned to their rotational speeds necessary for normal spinning. When the yarn being spun is nipped between the delivery rollers 18 and the varying speed motors 24, 25 are returned to their low-speed operation, the operating condition of the spinning unit is exactly the same as before the occurrence of yarn breakage, the driving system being ready for the occurrence of possible yarn breakage at some other spinning unit. FIG. 5 shows the operational sequence of the solenoids 22, 29 clutches 11, 12, 20 and the varying speed motors 24, 25 with time. In the FIG. 5, A, B, C, D, E and F represent the operational steps as follows:

A; yarn breakage
B; cleaning of rotor and preparation for yarn piecing
C; throw in end yarn
D; start of winding
E; varying speed
F; change The opening roller 16 is rotated at a constant speed by a separate electric motor 46 through a belt 47, as the rotational speed of the opening roller 16 has no relation with the yarn piecing operation. The number of twists inserted to the yarn during the yarn piecing is slightly increased over that during normal spinning but, unlike the different count of yarn, the different number of twists can be compensated by transmission of the twist as the yarn travels towards the drum 2. Generally, a higher design number of revolutions of the rotor is preferred for such reason that the taking-out speed of the spun yarn can be increased in direct proportion to the number of revolutions of the rotor for inserting a soft twist in the yarn. Moreover, the increase in the taking-out speed gives rise to the corresponding increase in the yarn tension thereby providing an improved twist transmission and interlocking between the yarn and the fiber.

When the spinning units are started in unison after transient cessation of spinning operation, the motors 5, 6 adapted for normal spinning are rotated at a slow speed, and the end yarns are thrown simultaneously into the respective spinning rotors for concurrent yarn piecing and starting of the spinning operation. These motors 5, 6 are accelerated simultaneously after the start of the spinning so as to attain their maximum speeds simultaneously. Thus, the normal spinning is started. It is therefore necessary to select the speed-up mode of the motor 5 and that of the motor 6 so that the above equations (3) and (4) may be satisfied.

Figure 9:
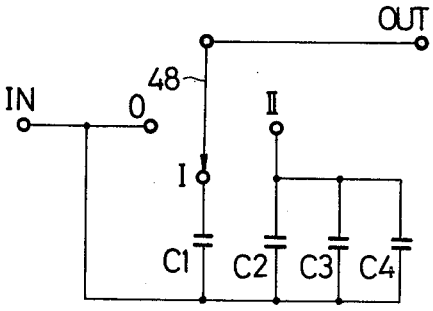
FIG. 9 is a diagram showing a circuit used in the first embodiment for selecting the speed-up ratio of the electric motor.

The speed-up mode of the motor 5 or 6 can be designed properly by providing a feedback speed control loop in the motor in a known manner and connecting said control loop to the output side of a timing circuit such as is shown in FIG. 9. In this timing circuit, the point zero on an indicating dial, not shown, is connected directly to the input of the timing circuit, while the points I and II are connected with the input of the circuit via a capacitor $C_1$ and a parallel combination of capacitors $C_2$, $C_3$, and $C_4$, respectively. The capacitances of capacitors $C_1$–$C_4$ can be selected suitably so that, when the movable contact of a switch 48 is set to said points O, I and II, the design speed of the motor will be reached after fixed time intervals of say zero, 2 and 20 seconds. The motor speed-up mode can be adjusted finely and steplessly by providing a variable resistor in the timing circuit.

Figure 6:
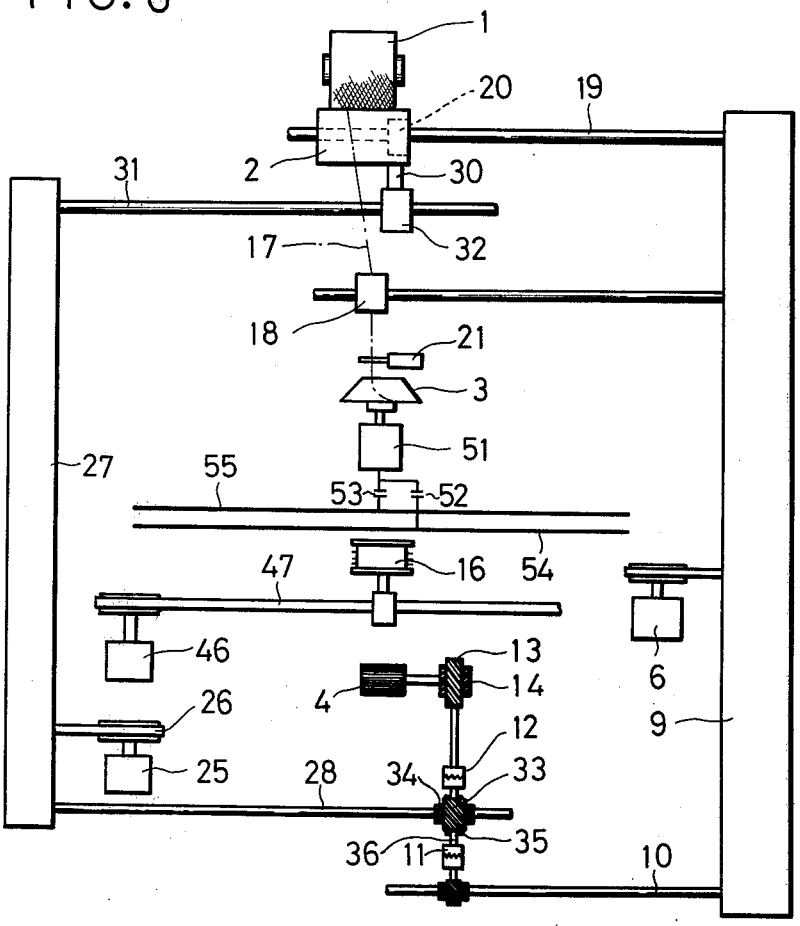
FIG. 6 is a diagrammatic view of a motion-transmitting mechanism used in a second embodiment of the invention.

A second embodiment of the present invention is shown in FIG. 6.

In the embodiment of FIG. 3, the rotor shaft 8 is engaged alternately by a belt 7 travelling at a constant speed and a belt 23 travelling at a variable speed. In this embodiment, the rotational speed of the rotor 3 is limited by such factors such as service life of the bearing members and the load carrying capacity of the belt and can not be increased over say 70,000 r.p.m. Thus, in the present second embodiment, each rotor 3 is connected directly to a high-speed motor and the motor speed is changed for changing the rotational speed of the rotor for yarn-piecing and normal spinning. This high-speed motor can be arranged as for instance a frequency motor. A higher rotational speed is not required for the varying speed motors used for winding the yarn and supplying the sliver. Thus, the varying speed motor can be arranged and constructed as a d. c. motor or an ordinary induction motor provided that the output shaft of the motor is connected to a magnetic coupling with variable rotational speed at the output shaft. It is to be noted that the equations (3) and (4) relative to the rotational speeds of the spinning elements during the yarn-piecing and normal spinning should be satisfied in the present embodiment. In FIG. 6, the same parts are denoted by the same reference letters or numerals as in the preceding embodiment shown in FIGS. 3 and 4.

In the present second embodiment, shown in FIG. 6, the rotor 3 is rotated by a frequency motor 51 connected directly to the rotor 3. The motor 51 is connected to a frequency generating electrical source 54 or 55 by selectively closing a switch 52 or 53, respectively. The electrical source 55 is designed to produce a high frequency so as to rotate the frequency motor 51 at a high speed upon closing the switch 53 for performing the normal spinning. The electrical source 54 is designed to produce a normally low frequency so as to rotate the frequency motor at a low speed upon closing the switch 52 for yarn piecing. After completion of the yarn piecing, the frequency is elevated to a value equal to or slightly smaller than that produced by the electrical source 55. After the latter frequency is attained at the electrical source 54, the switch 52 is turned off while the switch 53 is turned on for realizing the normal spinning condition. The switches 52, 53 can be operated manually or automatically by a suitable program with the aid of timing devices.

Other details of the present second embodiment are exactly the same as in the preceding embodiment shown in FIG. 3 and 4.

Figure 7:
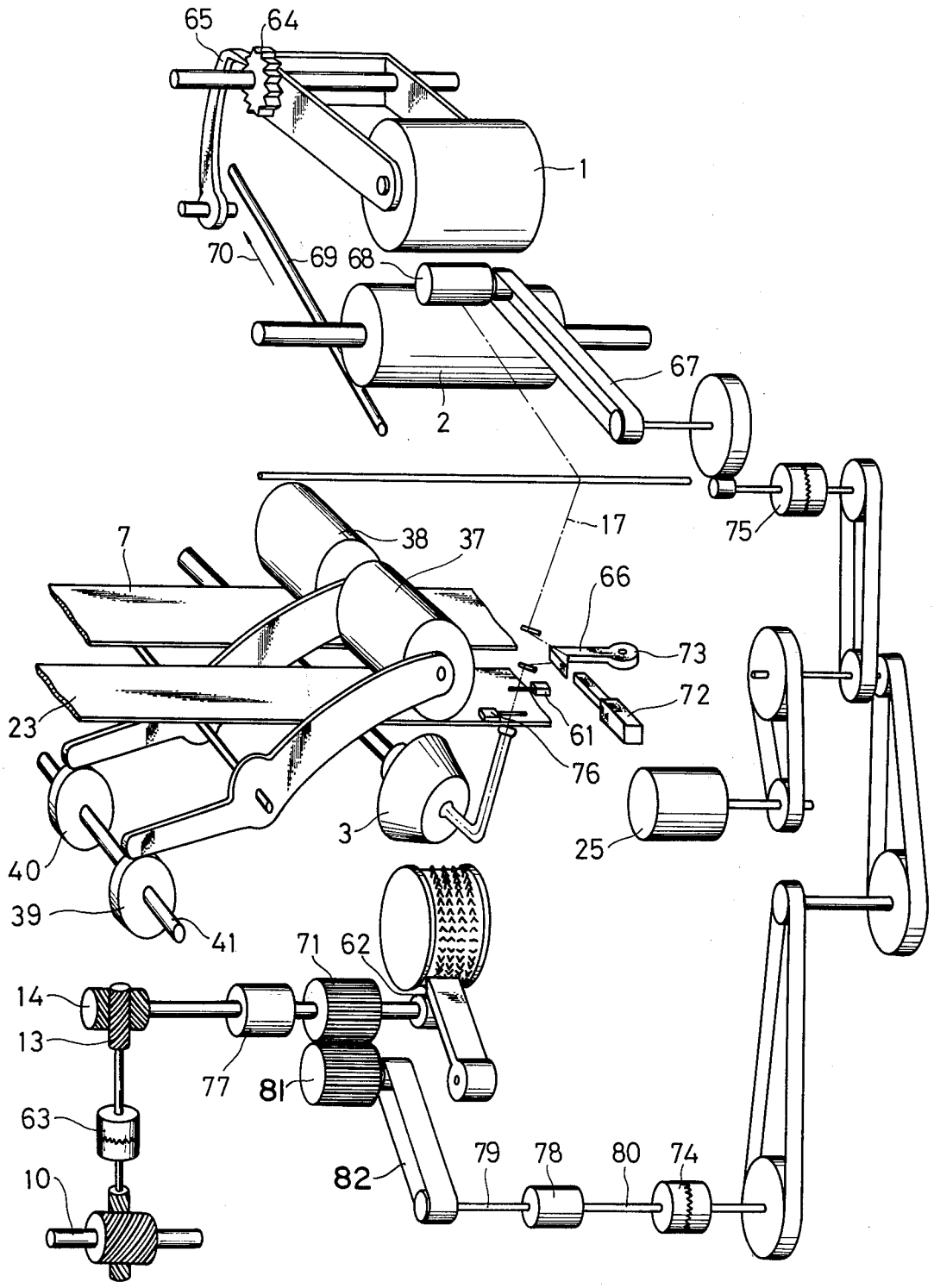
FIG. 7 is a diagrammatic perspective view of a third embodiment of the invention.

A third embodiment of the invention is shown in FIG. 7.

In the first embodiment shown in FIGS. 3 and 4, the speed-changing electric motors 24, 25 and the gearing 27 are provided in the frame of the spinning base. In the present third embodiment, the varying speed motor 24 is provided in the frame of the spinning unit, while the speed changing motor 25 and the gearing 27 are built into a travelling unit, not shown, which is adapted to travel along the front side of the spinning units and be stopped at the spinning unit where the yarn breakage has occurred. The normal spinning is restarted at the spinning unit after the broken yarn is pieced up to the fresh sliver.

In the present embodiment, shown in FIG. 7, when the yarn breakage should take place, a sensor 61 senses such yarn breakage and issues an electrical signal to disconnect a clutch 63 of a feed roller 62. In this case, an operator may easily detect the spinning unit where the yarn breakage has occurred. The package 1 is lifted manually at this time away from a wind-up drum 2 by the operator and a detent 65 is engaged manually with a ratchet wheel 64 for setting the package in a desired fixed position. Then the end of the yarn wound on the package 1 is groped and the yarn is unreeled partially from the package 1. The unreeled yarn is cut to a certain length from the groped end, and the yarn length thus cut is sucked into a suction pipe 67 through a yarn hook 66 provided to the frame of the spinning unit, said suction pipe 67 communicating with the inside of the rotor 3. Thus the clutch 20 provided in the preceding embodiments may be omitted and the wind-up package is lifted manually away from the drum 2 which is rotated continuously.

When the above-mentioned manual operation is terminated, and the travelling unit, not shown, detects a spinning unit where yarn breakage has occurred, as it travels along the front side of a parallel array of the spinning units, a shaft 41 is engaged with said travelling unit through a coupling, not shown provided to the latter. Cams 39, 40 secured to the shaft 41 are rotated partially so that a pulley 38 associated with the cam 40 is moved away from a high-speed belt 7 and a pulley 37 associated with the cam 39 is moved towards a low-speed belt 23. Thus the rotor shaft is disengaged from the high-speed pulley 7 and brought into pressure contact with the low-speed pulley. Then a roller 68 connected with a low-speed driving source 25 through a belt 67 and a gear 81 connected with said driving source through a belt 82 are moved forwards by an interlock mechanism, which is omitted from the drawing for the sake of clarity. A rod 69 is also moved forwards in a direction shown by an arrow mark 70 by said interlock mechanism so as to disconnect the detent 65 from the ratchet wheel 64 so that the package 1 comes into contact with the roller 68. The gear 81 comes into meshing with a gear 71 mounted coaxially with a feed roller 62.

Then a solenoid 72 provided to the traveller is energized to rotate the hook 66 about a pin 73 to permit the yarn 17 to be sucked into the rotor. As the yarn end gets to the collecting inner surface of the rotor 3, the tension applied to the yarn end will be increased under the effect of the centrifugal force in the rotor. The sensor 61 senses such tension increase and operates to connect a clutch 74 so that the feed roller 62 starts to rotate. After a time period of T1 second from the time of energization of the sensor 61, a clutch 75 is engaged to start the rotation of the wind-up package during this low-speed operation, the ratio of the rotational speed of the package 1 to that of the feed roller 62 is the same as that at the time of normal high-speed spinning, as the package 1 and the feed roller 62 are connected to the same drive source 25 which has a certain fixed ratio of rotational speed relative to a high-speed driving source.

The sensor 61 provided to the traveller is receded from its sensing position and the yarn 17 comes into contact with another sensor 76 which is thereby energized to connect a clutch 63 so as to set the feed roller 62 into high-speed rotation. Then, the gear 68 connected to the travelling unit are receded into non-operative positions by a mechanism, not shown, so that the high-speed rotation of the drum 2 may again be transmitted again to the wind-up package 1. The shaft 41 connected to the cams 40, 41 is rotated partially to connect the rotor shaft with the high-speed belt 7 so that the rotor 3 starts to rotate at a higher speed. Thereafter, the travelling unit starts to travel along the parallel row of spinning units towards some other spinning unit where the yarn breakage has possibly occurred. A one-way clutch 77 operates to transmit only the high-speed rotation from the high-speed source to the feed roller 62 when the feed clutch 63 is connected, and a one way clutch 78 operates to permit the shaft 79 to rotate at a higher speed than the shaft 80 and transmit only the low speed rotation from the low-speed drive source 25 to the feed roller 62.

In starting the spinning units in unison, the motors 5, 6 are driven at reduced speeds for piecing the yarn simultaneously at the respective units and are speeded up later for normal speed spinning, as described with referrence to FIGS. 3 and 4.

In the present embodiment, only the motor 24 for changing the speed of the spinning rotor is provided in the spinning unit. As an alternative measure, only the wind-up device may be actuated by the travelling unit and both the rotor and the feed roller may be provided in the frame of the spinning unit, as in the case of the preceding embodiment 1. Still alternatively, only the feed roller may be actuated by the travelling unit and the remaining spinning elements may be actuated by speed changing devices provided in the frame of the spinning unit. In the preceding embodiments, the rotational speed of the rotor is switched from that used for yarn piecing to that used for normal spinning and vice versa, but the rotational speed of the rotor may be kept constant and the rotational speed of the winding device as well as that of the feed roller may be changed appropriately for yarn piecing and normal spinning.

Finally, in the preceding three embodiments of the present invention, the preparation and injection into the spinning rotor of the end yarn and the cleaning of the rotor are carried out by manual operation, but the various devices adapted to perform the above procedure, such as air sucker for unreeling an end yarn, a cutter for cutting the end yarn at a prefixed position and an air compressor for cleaning the inside space of the rotor may be provided in a separate travelling, or in the same unit described in connection with the embodiment shown in FIG. 3, for realizing a full automation of the spinning process.

What is claimed is:

1. A driving device for an open-end spinning system formed by a number of juxtaposed spinning units each comprising a rotor, a feed roller for supplying a sliver into the rotor, and a package driving drum for taking spun yarn out of the rotor, said device being characterized by a main drive transmission system and an auxiliary drive transmission system provided in common to said spinning units each of which spinning units is operatively linked with said main and auxiliary transmission systems so as to be switched separately and individually from high speed operation to low speed operation and vice versa with the aid of said transmission systems, said auxiliary transmission system including two separate drive sources for each of said spinning units, one of said separate drive sources being connected to said rotor of the associated spinning unit and the other of said separate drive sources being connected to both said feed roller and said package driving drum of the associated spinning unit, said drive sources having different speed changing modes, said main and auxiliary driving systems each including a separate transmission belt for driving the rotor.

2. A method of re-starting a spinning process in an open-end spinning machine having at least one rotor, a feed roll for feeding fiber to the rotor and a take-off roll for taking off yarn from the rotor, said method comprising the steps of rotating the rotor, feed roll and take-off roll during start-up at speeds lower than production speeds and at which the ratios of rotational speeds of the feed roll and take-off roll with respect to the rotational speed of the rotor are reduced; and thereafter rotating the rotor, feed roll and take-off roll at the production speeds at which the ratios of rotational speeds of the feed roll and take-off roll with respect to the rotational speed of the rotor are not reduced.

3. A method as set forth in claim 2 wherein the rotational speeds of the feed roll and the take-off roll with respect to the rotor speed are reduced at the same ratio.

4. A method of open-end spinning of thread, comprising the steps of:

(A) twisting the open end of the thread at a pre-determined twisting rate;

(B) drawing off the thread at a pre-determined draw-off speed; and (C) increasing the numerical ratio of said twisting rate to said draw-off speed whenever the thread is being reattached to the roving and whenever a thread breakage is being repaired, wherein the step of increasing the ratio of said twisting rate to said draw-off speed is performed while said twisting rate is lower than it is during normal spinning machine operation.

5. A method as claimed in claim 4 comprising the further step of:

(D) reducing the supply of fibers to the spinning chamber while said ratio of twisting rate to draw-off speed is being increased, thereby maintaining the thread gauge substantially constant.

* * * * *